US007287330B1

(12) United States Patent
Riha

(10) Patent No.: US 7,287,330 B1
(45) Date of Patent: Oct. 30, 2007

(54) CHAIN SAW AUTOMATIC TENSIONER

(75) Inventor: Gary D. Riha, Green Bay, WI (US)

(73) Assignee: G&R Equipment, LLC, Lena, WI (US)

( * ) Notice: Subject to any disclaimer, the term of this patent is extended or adjusted under 35 U.S.C. 154(b) by 478 days.

(21) Appl. No.: 10/953,731

(22) Filed: Sep. 29, 2004

(51) Int. Cl.
*B27B 17/00* (2006.01)

(52) U.S. Cl. ..... 30/381; 30/386; 83/814

(58) Field of Classification Search ..... 83/809, 83/813, 814–819; 30/381–386; 144/34.1, 144/4.1, 336
See application file for complete search history.

(56) References Cited

U.S. PATENT DOCUMENTS 2,910,100 A * 10/1959 Hoff et al. ..... 30/386
3,884,106 A * 5/1975 Aizawa ..... 83/453
4,819,335 A * 4/1989 Alexander ..... 30/500
5,528,835 A * 6/1996 Ra ..... 30/386
5,709,254 A 1/1998 Argue ..... 144/34.1
6,032,373 A 3/2000 Peterson ..... 30/386
6,311,599 B1 * 11/2001 Lindehall ..... 83/819
6,539,832 B1 4/2003 Nilsson ..... 83/818

* cited by examiner

*Primary Examiner*—Boyer D. Ashley
*Assistant Examiner*—Omar Flores Sánchez
(74) *Attorney, Agent, or Firm*—Donald J. Ersler

(57) ABSTRACT

A chain saw automatic tensioner preferably includes a base plate, a chain bar, a tensioning cylinder, a sliding block and a pusher block. The base plate includes a sliding slot that is sized to slidably receive the sliding block. The chain bar includes a substantially half oval shape that is sized to retain a cutting chain. An end of the chain bar is retained between a top of the sliding block and a bottom of the pusher block. The tensioning cylinder is mounted to the base plate opposite the sliding slot. Hydraulic oil in the tensioning cylinder forces a cylinder rod and the pusher block secured to the chain bar away from a chain sprocket and thus tensioning the cutting chain.

16 Claims, 2 Drawing Sheets

CHAIN SAW AUTOMATIC TENSIONER

BACKGROUND OF THE INVENTION

1. Field of the Invention

The present invention relates generally to chain saws and more specifically to a chain saw automatic tensioner, which keeps a cutting chain of a chain saw tensioned during use.

2. Discussion of the Prior Art

The prior art includes at least three patents that disclose chain saw tensioners. U.S. Pat. No. 5,709,254 to Argue discloses a tree harvesting apparatus. The Argue patent includes a chain saw chain detensioning system, which permits a quick removal of a saw chain from the chain saw without the use of tools. U.S. Pat. No. 6,032,373 to Peterson discloses methods and apparatus for adjusting chain saw tension. The Peterson patent includes a first piston operable to move the support bar radially away from the drive sprocket and a second piston is operable to limit such movement. U.S. Pat. No. 6,539,832 to Nilsson discloses a hydraulic stretching device for a chain saw. The Nilsson patent includes a hydraulic stretching device for a saw chain active in a sawing apparatus.

Accordingly, there is a clearly felt need in the art for a chain saw automatic tensioner, which keeps a cutting chain of a chain saw tensioned during use and has the unexpected result of protecting a cutting chain from flying off a chain sprocket.

SUMMARY OF THE INVENTION

The present invention provides a chain saw automatic tensioner, which prevents a cutting chain from flying off a chain sprocket. The chain saw automatic tensioner preferably includes a base plate, a chain bar, a tensioning cylinder, a sliding block and a pusher block. The base plate includes a sliding slot that is sized to slidably receive the sliding block. The chain bar includes a substantially half oval shape that is sized to retain a cutting chain. One end of the chain bar is retained between a top of the sliding block and a bottom of the pusher block. The tensioning cylinder is mounted to the base plate, opposite the sliding slot. Pressurized hydraulic oil in the tensioning cylinder forces a cylinder rod and the pusher block secured to the chain bar away from a chain sprocket and thus tensioning the cutting chain.

Accordingly, it is an object of the present invention to provide a chain saw automatic tensioner, which keeps a cutting chain of a chain saw tensioned during use.

Finally, it is another object of the present invention to provide a chain saw automatic tensioner, which has the unexpected result of protecting a cutting chain from flying off a chain sprocket.

These and additional objects, advantages, features and benefits of the present invention will become apparent from the following specification.

DETAILED DESCRIPTION OF THE PREFERRED EMBODIMENTS

Figure 1:
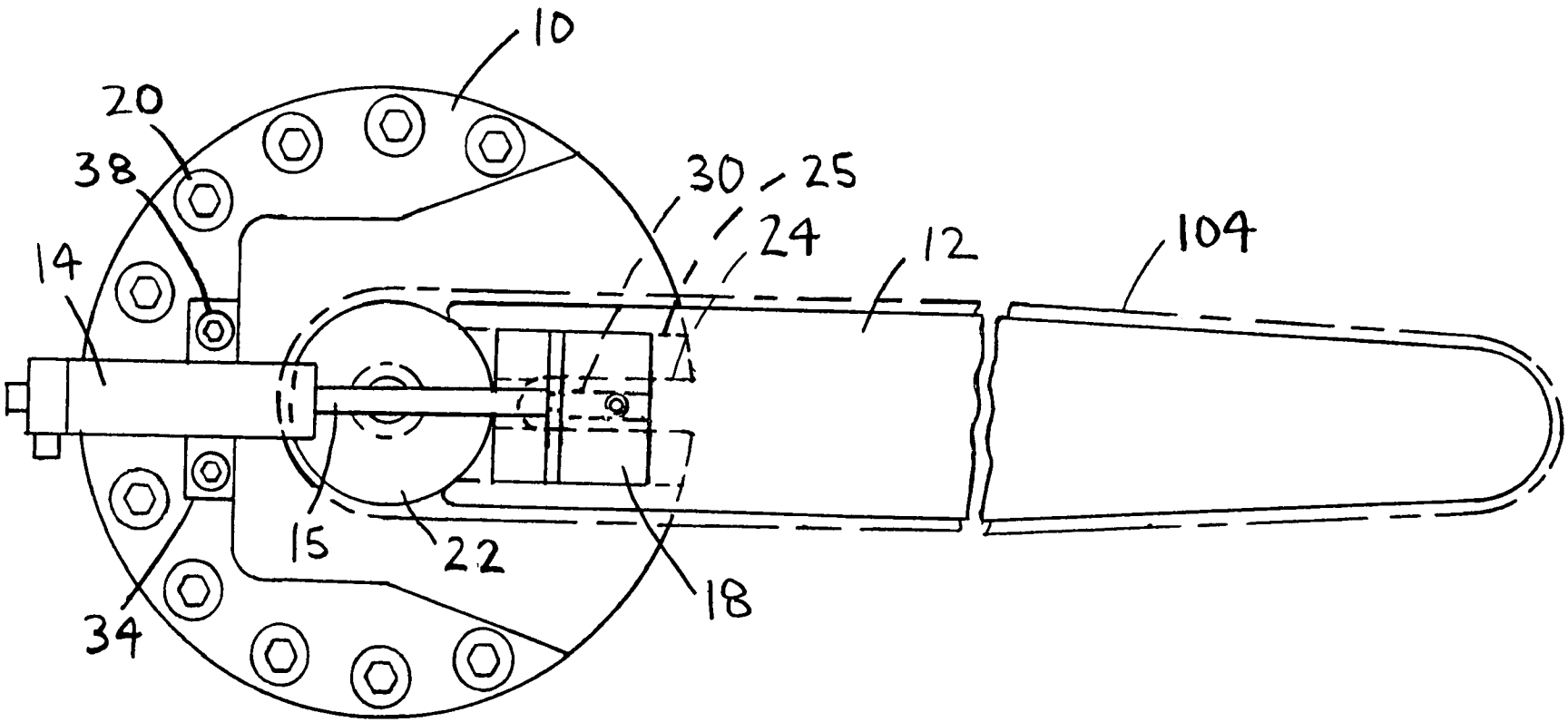
FIG. 1 is a top view of a chain saw automatic tensioner in accordance with the present invention.
Figure 2:
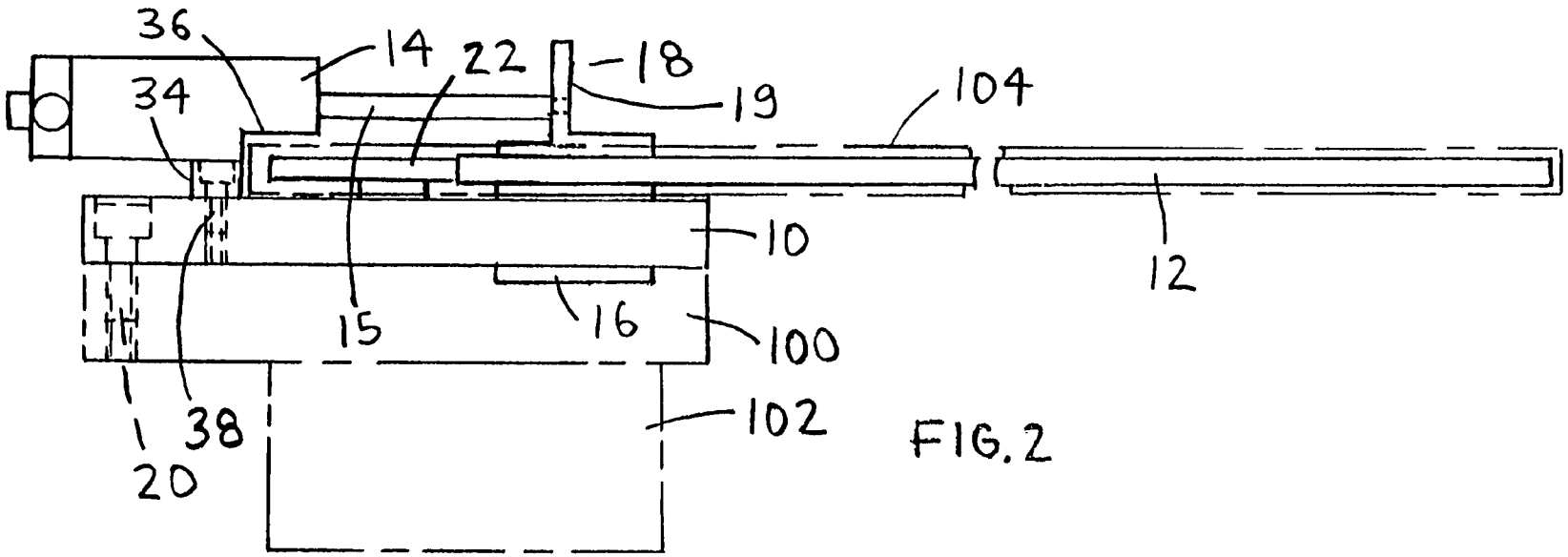
FIG. 2 is a side view of a chain saw automatic tensioner in accordance with the present invention.
Figure 3:
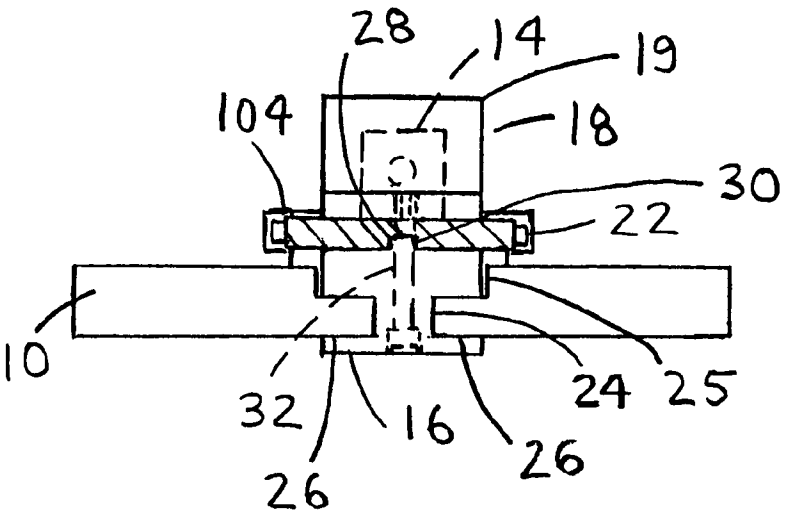
FIG. 3 is a front end view of a chain saw automatic tensioner in accordance with the present invention.

With reference now to the drawings, and particularly to FIG. 1, there is shown a top view of a chain saw automatic tensioner 1. The chain saw automatic tensioner 1 preferably includes a base plate 10, a chain bar 12, a tensioning cylinder 14, a sliding block 16 and a pusher block 18. The base plate 10 is attached to a slew ring 100 of a processing head with a plurality of fasteners 20. The processing head is manufactured by G & R Equipment of Lena, Wis. A drive motor 102 is received by the slew ring 100 and attached to the base plate with at least one fastener. A drive sprocket 22 is attached to a drive shaft of the drive motor 102. The base plate 10 includes a sliding slot 24 that is sized to slidably receive the sliding block 16. A clearance slot 25 is also formed in the base plate 10 adjacent the sliding slot 24 to provide clearance for a top portion of the sliding block 16. The sliding block 16 preferably includes a pair of opposed slots 26 and a key projection 28. The opposed slots 26 are formed in opposed sides of the sliding block 16 and are sized to slidably receive the sliding slot 24. The key projection 28 extends across a top of the sliding block 16.

The chain bar 12 includes a substantially half oval shape and a thickness that is sized to retain a cutting chain 104. A key slot 30 is formed in an end of the chain bar 12 to receive the key projection 28. The chain bar 12 is retained between a top of the sliding block 16 and a bottom of the pusher block 18 with at least one fastener 32. The tensioning cylinder 14 preferably includes a mounting block 34 and a clearance slot 36. A hydraulic tensioning cylinder 14 is shown and described, but other actuation devices may also be used. The mounting block 34 is attached to a bottom of the tensioning cylinder 14 with welding or any other suitable method. The clearance slot 36 is cut in a front and bottom portion of the tensioning cylinder 14 to provide clearance for the cutting chain 104 and chain sprocket 22. The tensioning cylinder 14 is mounted to one side of the base plate 10 opposite the sliding slot 24 with at least two fasteners 38 inserted through the mounting block 34 and threaded into the base plate 10. Pressurized hydraulic oil is supplied from a tree cutting unit. The pressurized hydraulic oil in the tensioning cylinder 14 forces a cylinder rod 15 and the pusher block 18 to slide the chain bar 12 away from the chain sprocket 22 and thus tensioning the cutting chain 104. An end of the cylinder rod 15 is preferably threaded into a rod extension 19 of the pusher block 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of automatically tensioning a cutting chain of a chain saw, comprising the steps of:

providing a base plate;

engaging slidably one end of a chain bar with said base plate;

attaching an actuation device to one side of said base plate, said actuation device having an actuation end, said actuation end being in contact with said one end of said chain bar;

engaging slidably a sliding block with said base plate opposite said actuation device, retaining said one end of said chain bar between said sliding block and a pusher block;

retaining a chain sprocket above said one side of said base plate, said chain sprocket and said chain bar retaining a cutting chain; and positioning said actuation end over said chain sprocket.

2. The method of automatically tensioning a cutting chain of a chain saw of claim 1, further comprising the step of:

forming a key slot in said one end of said chain bar, extending a key projection from said sliding block, said key slot being sized to receive said key projection.

3. The method of automatically tensioning a cutting chain of a chain saw of claim 1, further comprising the step of:

retaining said one end of said chain bar between said sliding block and said pusher block with at least one fastener.

4. The method of automatically tensioning a cutting chain of a chain saw of claim 1, further comprising the step of:

providing a hydraulic cylinder for said actuation device and a cylinder rod for said actuation end.

5. The method of automatically tensioning a cutting chain of a chain saw of claim 1, further comprising the step of:

forming a clearance slot in an end and bottom of said actuation device to provide clearance for said chain sprocket.

6. The method of automatically tensioning a cutting chain of a chain saw of claim 1, further comprising the step of:

rotating said chain sprocket with a motor.

7. A method of automatically tensioning a cutting chain of a chain saw, comprising the steps of:

providing a base plate with a sliding slot;

providing a sliding block that is sized to be slidably received by said sliding slot;

attaching one end of a chain bar to said sliding block;

retaining said one end of said chain bar between said sliding block and a pusher block;

attaching an actuation device to one side of said base plate opposite said sliding slot, said actuation device having an actuation end, said actuation end being in contact with said one end of said chain bar;

retaining a chain sprocket above said one side of said base plate, said chain sprocket and said chain bar retaining a cutting chain; and positioning said actuation end over said chain sprocket.

8. The method of automatically tensioning a cutting chain of a chain saw of claim 7, further comprising the step of:

forming a key slot in said one end of said chain bar, extending a key projection from said sliding block, said key slot being sized to receive said key projection.

9. The method of automatically tensioning a cutting chain of a chain saw of claim 7, further comprising the step of:

retaining said one end of said chain bar between said sliding block and said pusher block with at least one fastener.

10. The method of automatically tensioning a cutting chain of a chain saw of claim 7, further comprising the step of:

providing a hydraulic cylinder for said actuation device and a cylinder rod for said actuation end.

11. The method of automatically tensioning a cutting chain of a chain saw of claim 7, further comprising the step of:

forming a clearance slot in an end and a bottom of said actuation device to provide clearance for said chain sprocket.

12. The method of automatically tensioning a cutting chain of a chain saw of claim 7, further comprising the step of:

rotating said chain sprocket with a motor.

13. A method of automatically tensioning a cutting chain of a chain saw, comprising the steps of:

providing a base plate, forming a sliding slot in said base plate;

providing a sliding block that is sized to be slidably received by said sliding slot;

attaching one end of a chain bar to said sliding block;

attaching a pusher block to a top of said chain bar at said one end thereof;

retaining said one end of said chain bar between said sliding block and said pusher block with at least one fastener;

attaching a hydraulic cylinder to one side of said base plate opposite said sliding slot, said hydraulic cylinder having a cylinder rod, said cylinder rod end being engaged with said pusher block;

retaining a chain sprocket above said one side of said base plate, said chain sprocket and said chain bar retaining a cutting chain; and positioning a portion of said hydraulic cylinder and said cylinder rod over said chain sprocket.

14. The method of automatically tensioning a cutting chain of a chain saw of claim 13, further comprising the step of:

forming a key slot in said one end of said chain bar, extending a key projection from said sliding block, said key slot being sized to receive said key projection.

15. The method of automatically tensioning a cutting chain of a chain saw of claim 13, further comprising the step of:

forming a clearance slot in an end and a bottom of said actuation device to provide clearance for said chain sprocket.

16. The method of automatically tensioning a cutting chain of a chain saw of claim 13, further comprising the step of:

rotating said chain sprocket with a motor.

* * * * *